United States Patent [19]

Oppenheim et al.

[11] 4,330,203

[45] May 18, 1982

[54] OPTICAL LENS LAYOUT AND BLOCKING DEVICE

[76] Inventors: Gerd Oppenheim, 73 Sunview Dr., San Francisco, Calif. 94131; Angus MacDonald, 1711-24th Ave., Oakland, Calif. 94601

[21] Appl. No.: 84,848

[22] Filed: Oct. 15, 1979

[51] Int. Cl.[3] ..... B22D 19/00

[52] U.S. Cl. ..... 356/127; 51/216 LP

[58] Field of Search ..... 356/127; 51/216 LP, 51/277; 33/174 A

[56] References Cited

U.S. PATENT DOCUMENTS

| | | | |
|---|---|---|---|
| 2,917,971 | 12/1959 | Goddu et al. | 33/174 A |
| 3,049,766 | 8/1962 | Buckminster | 51/216 LP |
| 4,138,085 | 2/1979 | Bicskei | 356/127 |

*Primary Examiner*—R. A. Rosenberger

*Attorney, Agent, or Firm*—Manfred M. Warren; Robert B. Chickering; Glen R. Grunewald

[57] ABSTRACT

Given the known position of the optical center of an unfinished lens which is to be contoured for an eyeglass frame, this invention relates to a single device for locating and aligning the contemplated geometric center of what will be the finished lens with the optical center so that a block may be secured to the lens at such geometric center for holding the lens for contouring. The device comprises a lens holder situated above a slidable grid scale which is used in combination with a fixed scale to decenter the lens on the lens holder such that the contemplated geometric center of the lens will line up above the position of a block that may be accurately moved into place by moving the same slider containing the grid.

9 Claims, 4 Drawing Figures

OPTICAL LENS LAYOUT AND BLOCKING DEVICE

Our invention relates to the making of eyeglasses and more particularly to the tailoring of a pair of eyeglasses for a particular individual. To shape a pair of prescription ground lenses for a particular eyeglass frame, it is necessary to place the lens into the selected frame such that the optical center of the lenses are aligned with the wearers pupils and bifocals are at the right height and symmetrically located. The prescription ground lens must be contoured to the selected frame such that the optical center of the lens is decentered from the frame geometrical center and will align to the eye pupil separation of the user.

The decentration of the optical center of a lens from the geometrical center of the frame is determined on the basis of a known relationship between the proposed frame and the pupillary span of the user and is presented in the form of grid coordinates, i.e; positive or negative displacement along an X-axis and Y-axis.

To contour a lense, it is necessary to attach a holding block to the contemplated geometrical center of the lens, that point that will ultimately coincide with the frame geometrical center. This block will fit into a chuck on an edge cutting machine to secure and orient the lens during the shaping process.

Traditionally the lense is measured with a ruler or transparent scale to find the correct spot for attachment of the block. The spot is then marked and the lens is taken to a blocker where the block is attached using this marked spot as a guide. This process lends itself to inaccuracies and error and is time consuming.

Among the objects of our invention are:

(1) To provide a novel and improved layout and blocking device for lenses;

(2) To provide a novel and improved layout and blocking device for lenses having means for accurately decentering a lens for blocking;

(3) To provide a novel and improved layout and blocking device for lenses having means for accurately maintaining decentration while blocking;

(4) To provide a novel and improved layout and blocking device for lenses that permits layout and blocking on a single device.

Additional objects of the invention will be brought out in the following description of the same, taken in conjunction with the accompanying drawings wherein.

Figure 1:
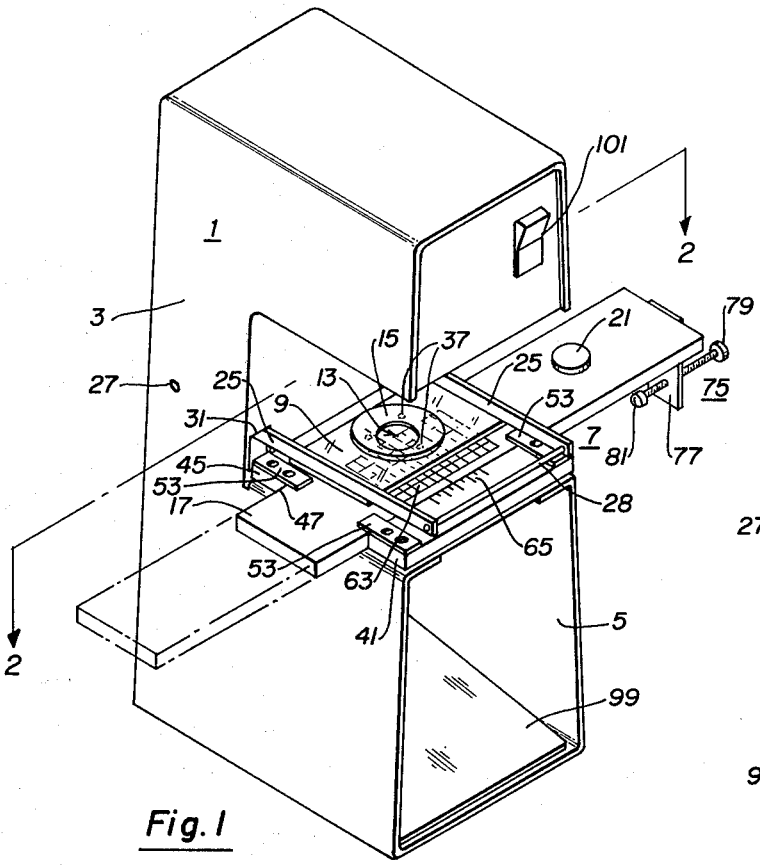
FIG. 1 is a view in perspective of the invention.

For details of our invention in its preferred form, reference will be had to the accompanying drawings wherein it can be seen that the optical lens layout and blocking device comprises a housing 1 having a side walls 3,5 with a section removed therefrom, a lens holder assembly 7 including a lens holder 9 having an opening 13 therethrough in alignment with a lens 15 placed thereon, a means for supporting the lens holder assembly on the housing, a slider 17, means for installing the slider such that it slides in a plane substantially parallel to the plane of the lens holder, means for accurately locating the contemplated geometric center of the lens with the vertical axis of the lens holder opening, means for accurately aligning the contemplated geometric center of the lens with the vertical axis of the lens holder opening, means for accurately aligning the contemplated geometric center of the lens with the vertical axis of a block 21, and means for securing the block to the lens geometric center in an accurately aligned relationship whereby a single device may provide for accurate attachment of a block to the contemplated geometric center of the finished lens.

To support the lens during layout and blocking, the lens holder assembly includes a pair of spaced parallel arms 25, each attached to a side wall such that it can rotate about a point 27 near the rear end thereof. A depressor bar 28 unites the front ends of the parallel bars which are urged in a normal upward direction by a spring 29 toward the rear of each bar tending to rotate the bars about the rotatable connection 27. Rotation is limited by the upper edges 31 of two openings in a front plate 33 through which the arms pass. Spanning the underside of the two arms forward of the front plate, the lense holder 9 with the central opening 13 is rigidly secured. Around the central opening, three equally spaced rubber bumpers 37 are installed to provide triangular support to the convex side of the lens being worked upon.

The dual purpose slider 17 is comprised of a rectangular strip of transparent plastic of sufficient thickness to insure rigidity, and is installed below and in a plane substantially parallel to the lens holder assembly. The edges of the side walls 3, 5 adjacent the lower portion of the removed section are turned inward to form the basis of a shelf on which a front and rear guide 41, 45 are secured.

Figure 3:
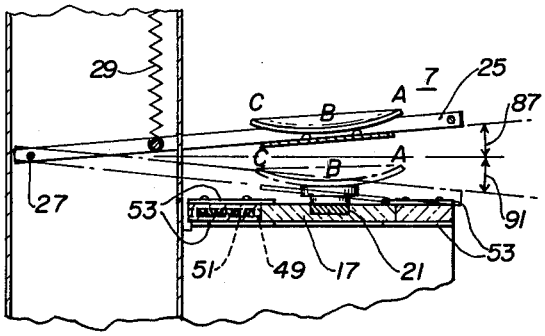
FIG. 3 is a side view in section depicting means for accurately securing a decentered lens to a block.
Figure 2:
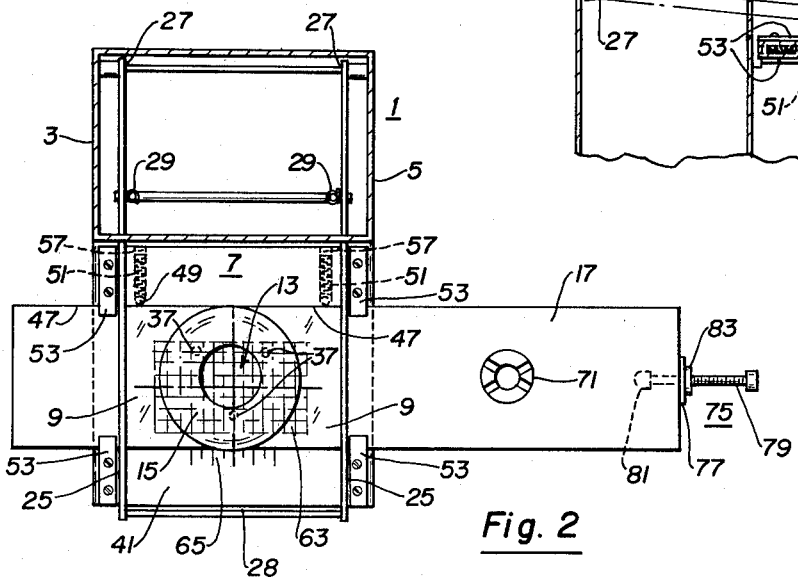
FIG. 2 is a plan view in section through the plane of 2—2 of FIG. 1.

The slider 17, slides between the guides 41 and 45. It is maintained in intimate contact with the front guide 41 by means of spring loaded ball bearings 49 installed in a transverse opening 51 in the rear guide. Pressure on the bearing is adjustable by means of a set screw 57 bearing against an interposed spring 59. The slider 17 is supported and restricted from vertical motion by small tabs 53 (see FIG. 3) which are attached so that they protrude just beyond the edge of the guides and support the slider.

In the preferred embodiment, the upper surface of the slider is frosted and provided with an imprinted grid network 63. This grid network in combination with a linear scale 65 on the front guide provide a means for accurately decentering a lens over the lens holder opening. The scale on the front guide includes a center line fixed in alignment with the center of the lens holder opening. The grid network on the slider includes an X-axis and a Y-axis intersecting at a point on the slider that is accurately alignable under the center of the lens holder opening. In other words, with the Y-axis of the grid network in alignment with the center line of the guide scale, the intersection of the X-axis and Y-axis will be at the center of the lens holder opening.

To locate the contemplated geometric center of a lens, the slider will be moved either positively or negatively a number of units along the guide scale as previously determined on a basis of a patient's pupillary distance and the distance between the optical center of the lens openings of the selected frames. This scale is generally calibrated in millimeters. The optical center of the lens to be contoured, which has been previously marked through a different process, is now placed on the lens holder opening in alignment over the intersection of the X and Y-axis. This optical center is now moved along the Y-axis in accordance with the numbers of units and direction provided by the prescriber. With the optical center of the lens thus displaced, the contemplated geometric center will now be aligned over the center of the lens holder opening.

A block holder 71 is installed relatively flush with the surface of the slide towards the opposite end thereof such that the vertical axis of the block holder intersects the X-axis of the grid. A block 21 now placed thereon may slide with the slider to a position of alignment directly under center of the lens holder opening. To limit slider movement and insure alignment accuracy of the block below the lens, an adjustable stop assembly 75 comprising a holder 77 and an adjustable element 79 is secured to the end of the slider. The stop element is adjustably threaded through the holder and includes a bumper 81 on its exposed end. It is adjusted so that the bumper comes into contact with the side wall when the vertical axis of the block holder passes through the center of the lens holder opening. Thus, repetitive accuracy is achievable when positioning the block holder.

To attach a block to the aligned lens over the lens holder opening, double sided tape is first attached to the block prior to its being positioned under the lens. The lense holder opening is swung through an arc by pressing gently on the center of the lense, thus bringing the lens holder opening down over the block to leave the positioned lens resting on the tape. Subsequent finger pressure insures adhesion.

It is necessary that vertical alignment between the lens and block after attachment be the same as existed prior to attachment. To achieve this end, the lens holder rotates about axis 27 from a plane slightly above the plane of its center to a plane slightly below the plane of its center. The arc 87 (in the preferred embodiment approximately 3 degrees) that exists above the plane of its center must equal the arc 91 that it traverses below the plane of its center to the point of contact with the block. With this relationship, any point A, B or C on the lens in an adjustment position will be vertically above the same points A, B and C on the lens in contact position with the block. This provides vertical integrity at the point of contact.

Figure 4:
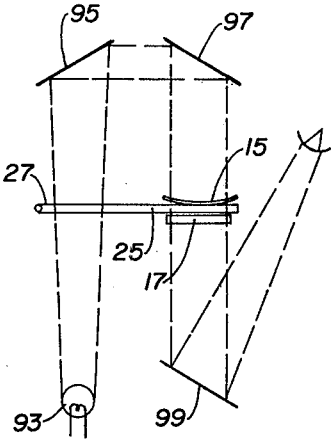
FIG. 4 is a diagram depicting the optics of the invention of FIG. 1.

The optics of the device are shown schematically in FIG. 4. Light from a high intensity lamp 93 reflects off first and second mirrors 95 and 97 to illuminate the lens which cast a shadow on the grid network in the frosted surface of the slider. An observer views the underside of the frosted surface by means of angled mirror 99 located at the bottom of the device. An on/off switch 101 on the upper part of the housing controls the high intensity lamp 93 through a transformer (not shown) wired in a normal conventional manner.

While we have illustrated and described our invention in its preferred form, it will be apparent that the same is subject to alteration, modification and additions without departing from the underlying priciples involved and we therefore do not desire to be limited in our protection to the specific details illustrated and described except as may be necessitated by the appended claims.

I claim:

1. A single optical lens layout and blocking device for locating and aligning the contemplated geometric center of a finished lens with a block to be secured to such lens at said contemplated geometric center for holding said lens for contouring, comprising a housing, a lens holder including an opening therethrough in alignment with a lens when placed thereon, means supporting said lens holder on said housing, a slider in spaced relationship to said lens holder, means for lineraly guiding said slider for movement with relationship to said lens holder in a plane substantially parallel to the plane of said lens holder, means for using a grid on said slider in conjunction with said lens holder for accurately locating and aligning said contemplated geometric center of said lens with the axis of said lens holder opening, means for supporting a block in a fixed position on said slider, means for using said slider in conjunction with said lens holder for accurately aligning the contemplated geometric center of said lens with the axis of said block, said last means including a stop between said housing and said slider adjusted as to position to limit movement of said slider when the axis of said block reaches the position of alignment with the contemplated geometric axis of such lens, and means for securing said block to said lens at said lens geometric center in said accurately aligned relationship.

2. An optical lens layout and blocking device in accordance with claim 1, characterized by means for installing said slider such that it slides in a plane substantially parallel to the plane of said lens holder comprising a front and a rear pair of fixed parallel spaced guides including edges for snuggly guiding said slider in alignment below said lens holder, and means for maintaining a snug relationship between said guided slider with at least one of said guide edges whereby, said slider has freedom of movement only in a direction defined by said parallel guide edges and is maintained in continual snug engagement with at least one of said guide edges to maintain an accurate relationship with said lens holder.

3. An optical lens layout and blocking device in accordance with claim 2, characterized by said means for maintaining a snug relationship between said slider and at least one of said guide edges including alignment elements on one of said guide edges bearing against an adjacent slider edge for maintaining a snug alignment relationship between the other of said slider edges and the proximate guide edge whereby, one edge of said slider is always in snug slidable relationship with guide edge.

4. An optical lens layout and blocking device in accordance with claim 1 characterized by said slider including a grid and said slider guide including a scale for use in cooperation with said slider grid to provide a means for accurately decentering said lens.

5. An optical lens layout and blocking device in accordance with claim 4 characterized by said decentering means comprising said slider guide scale including a centerline fixed in alignment with the center of said lens holder opening and said slider grid including an X-axis and Y-axis intersecting at a point accurately alignable under the center of said lens holder opening whereby, with said slider Y-axis displaced along said guide scale a distance equivalent to the X-coordinate of decentration of the optical center of an uncontoured lens from the contemplated geometric center of a finished lens the known optical center of said uncontoured lens may then be aligned on said lens holder opening over said X-axis and Y-axis intersection and thereafter displaced along said Y-axis a distance equivalent to the Y-coordinate of decentration to locate said contemplated geometric center of said lens over said axis of said lens holder.

6. An optical lens layout and blocking device in accordance with claim 1, characterized by means carried on said slider for aligning the contemplated geometric center of said lens with the axis of said block comprising a block-holder carried on said slider, said block-holder aligned with its axial center in longitudinal alignment with said X-axis of said grid, whereby, the axis of a block placed thereon may be accurately slid into alignment under the geometric center of a lens decentered upon said lens holder in respect to said grid.

7. An optical lens layout and blocking device in accordance with claim 6, characterized by means for limiting slider movement in one direction to effect accurate alignment between said block and said lens holder axis when in said limiting position whereby, accurate alignment may be achieved with no alignment effort by a user.

8. An optical lens layout and blocking device in accordance with claim 7, characterized by said slider limiting means comprising a stop assembly affixed below said slider, said stop assembly including a stop element in alignment with said housing and of sufficient dimension to abut said housing when said block axis is aligned with said lens opening axis.

9. An optical lens layout and blocking device in accordance with claim 1, characterized by said means for accurately securing said lens to said block comprising means for rotatably supporting said lens holder in an angular plane rotatable about a center located in a plane above said slider, through a small arc above said plane of said center, through an equal arc below said plane, and into contact with an adhesive on said block whereby vertical alignment of said lens over said block will be identical at the point of lens decentration and at the lower point of lens securement.

* * * * *